US006732563B1

(12) United States Patent
Chen

(10) Patent No.: US 6,732,563 B1
(45) Date of Patent: May 11, 2004

(54) RIVET TOOL HEAD

(76) Inventor: Dick Chen, No. 86, Wu-Ying Rd., Feng-Shan City, Kaohsiung Hsien (TW)

( * ) Notice: Subject to any disclaimer, the term of this patent is extended or adjusted under 35 U.S.C. 154(b) by 0 days.

(21) Appl. No.: 10/388,432

(22) Filed: Mar. 17, 2003

(51) Int. Cl.[7] ..... B21D 31/00; B21D 9/05
(52) U.S. Cl. ..... 72/391.8; 72/114; 29/243.53
(58) Field of Search ..... 72/391.8, 391.6; 29/243.521, 243.526, 243.53

(56) References Cited

U.S. PATENT DOCUMENTS 2,428,459 A * 10/1947 Hollwarth ..... 72/391.8
3,654,792 A * 4/1972 Mead ..... 72/114
4,229,960 A * 10/1980 Nilsson ..... 72/114
4,762,261 A * 8/1988 Hawly et al. ..... 29/243.53
6,539,768 B1 * 4/2003 Chen ..... 72/391.8

* cited by examiner

*Primary Examiner*—David B. Jones
(74) *Attorney, Agent, or Firm*—Rosenberg, Klein & Lee

(57) ABSTRACT

A rivet tool to be used with a rivet includes a tube adapted to be received in an adjusting knob, a transmission rod movably received in the tube and a bolt having a front threading and a rear threading corresponding to the front inner threading. The bolt securely engages with the transmission rod in such a way that there is no relative movement between the bolt and the transmission rod. A Y-shaped head is provided to engage with the rivet tool so that when the rivet is deformed due to movement of the tube, the transmission rod and the bolt, a peripheral edge of the rivet abuts the recessed area of the Y-shaped head, which conforms to an outer contour of an oval tube, so that after the deformation of the rivet and the rivet tool is removed, the appearance of the oval tube is smooth.

4 Claims, 6 Drawing Sheets

RIVET TOOL HEAD

BACKGROUND OF THE INVENTION

1. Field of the Invention

The present invention relates to a rivet tool head, and more particularly to a Y-shaped rivet tool head which is able to deform a peripheral edge of a rivet completely and smoothly.

2. Description of Related Art

A rivet tool is used to combine two objects together by using a rivet that is deformed at both peripheral edges in each of the objects. Another function of the rivet tool is to mount a rivet into a hole to function as an insert so that the operator is able to use the insert to connect to another object in later days. However, because the shapes of the two objects to be combined change fast, in order to cope with the introduction of new products, rivet tools change accordingly.

When the objects referred to are tubes, the current rivet tools are not able to satisfactorily accomplish the desired purpose. That is, when the rivet tool is using a rivet to a tube, due to the peripheral surface of the tube, the rivet can not be deformed satisfactorily and the distal peripheral edge of the rivet is not tidy so that after the rivet is mounted on the tube, the combination between two tubes is not secured and the exposed peripheral edge of the rivet easily cuts anyone in contact with it.

With reference to FIG. 6, a conventional rivet tool head is introduced to the market trying to solve the aforementioned problem. The conventional rivet tool head has a body (50) which has an outer threading (501) formed on an outer periphery of the body (50) and a through hole (51) defined through the body (50), a bolt (52) inserted into the through hole (51) and provided with a front threading (521) formed on a front portion of the bolt (52) and a rear threading (522) formed on a rear portion of the bolt (52), a tube (53) received in the body (50) and having an outer threading (531) corresponding to the rear threading (522) of the bolt (52) and a slit (532) defined in a periphery of the tube (53), a transmission rod (54) also received in the body (50) and inserted into the tube (53), the transmission rod (54) having a pin (542) inserted into the slit (532) of the tube (53) and an adjusting knob (57) in the body (50) to control movement of the transmission rod (54). The transmission rod (54) has a hexagonal head (541) inserted into the rear end of the bolt (52), therefore, rotation of the adjusting knob (57) is able to change traveling displacement of the tube (53) as well as the bolt (52).

When the rivet tool of this kind is in use, a rivet (not shown) is threadingly mounted on the front threading (521) of the bolt (52). When the bolt (52) is moving rearward relative to the rivet tool head, the rivet on the bolt (52) is deformed. However, when the rivet is inserted into a hole in a peripheral side face of an oval tube, deformation on peripheral edge of the rivet on the peripheral side face of the oval tube is not able to smoothly engage with the peripheral side face of the oval tube, which results in that the engagement of the rivet to the oval tube is not secured and thus damages the structural integrity.

To overcome the shortcomings, the present invention tends to provide an improved rivet tool head to mitigate and obviate the aforementioned problems.

SUMMARY OF THE INVENTION

The primary objective of the present invention is to provide an improved rivet tool having a Y-shaped head provided on a front portion of the rivet tool such that deformation of the rivet is able to satisfactorily and smoothly engage with a peripheral side face of the tube.

Other objects, advantages and novel features of the invention will become more apparent from the following detailed description when taken in conjunction with the accompanying drawings.

DETAILED DESCRIPTION OF THE PREFERRED EMBODIMENT

Figure 1:
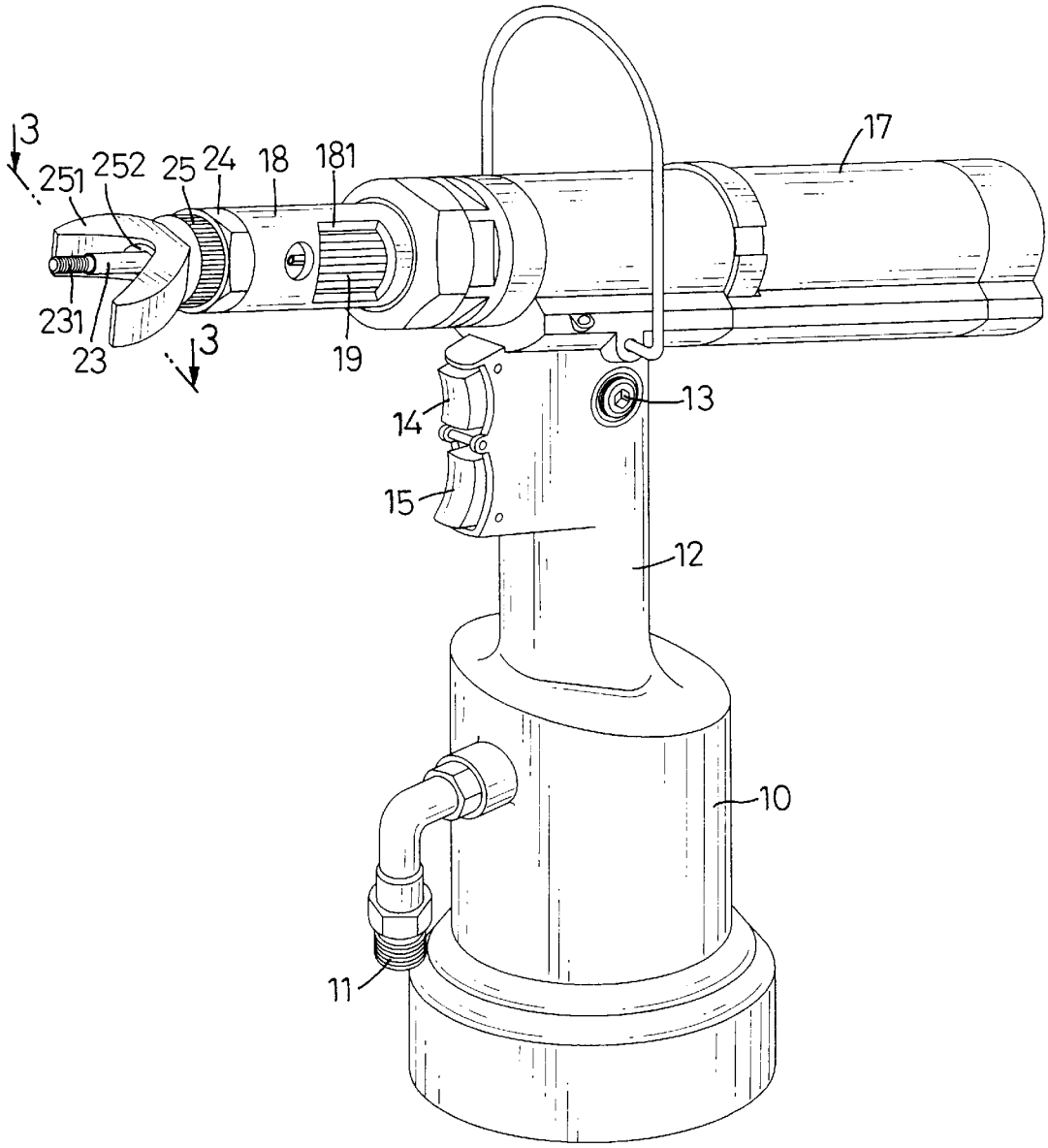
FIG. 1 is a perspective view of a rivet tool head mounted on a rivet tool of the present invention.

With reference to FIG. 1, a rivet tool constructed in accordance with the present invention has a body (10), a gas nozzle (11) mounted on a side of the body (10) to be connected to a gas pipe (not shown), an oil reservoir (12) defined inside the body (10) and having an inlet (13) for refilling oil into the oil reservoir (12), a first trigger (14), a second trigger (15), a motor (17) mounted in a rear of the oil reservoir (13), a sleeve (18) mounted on a front portion of the rivet tool and having a cutout (181) defined in a side face of the sleeve (18) and an adjusting knob (19) rotatably received in the cutout (181). It is to be noted that the components above are only preliminarily described, detailed description thereof is omitted because they are well-known in the art.

Figure 2:
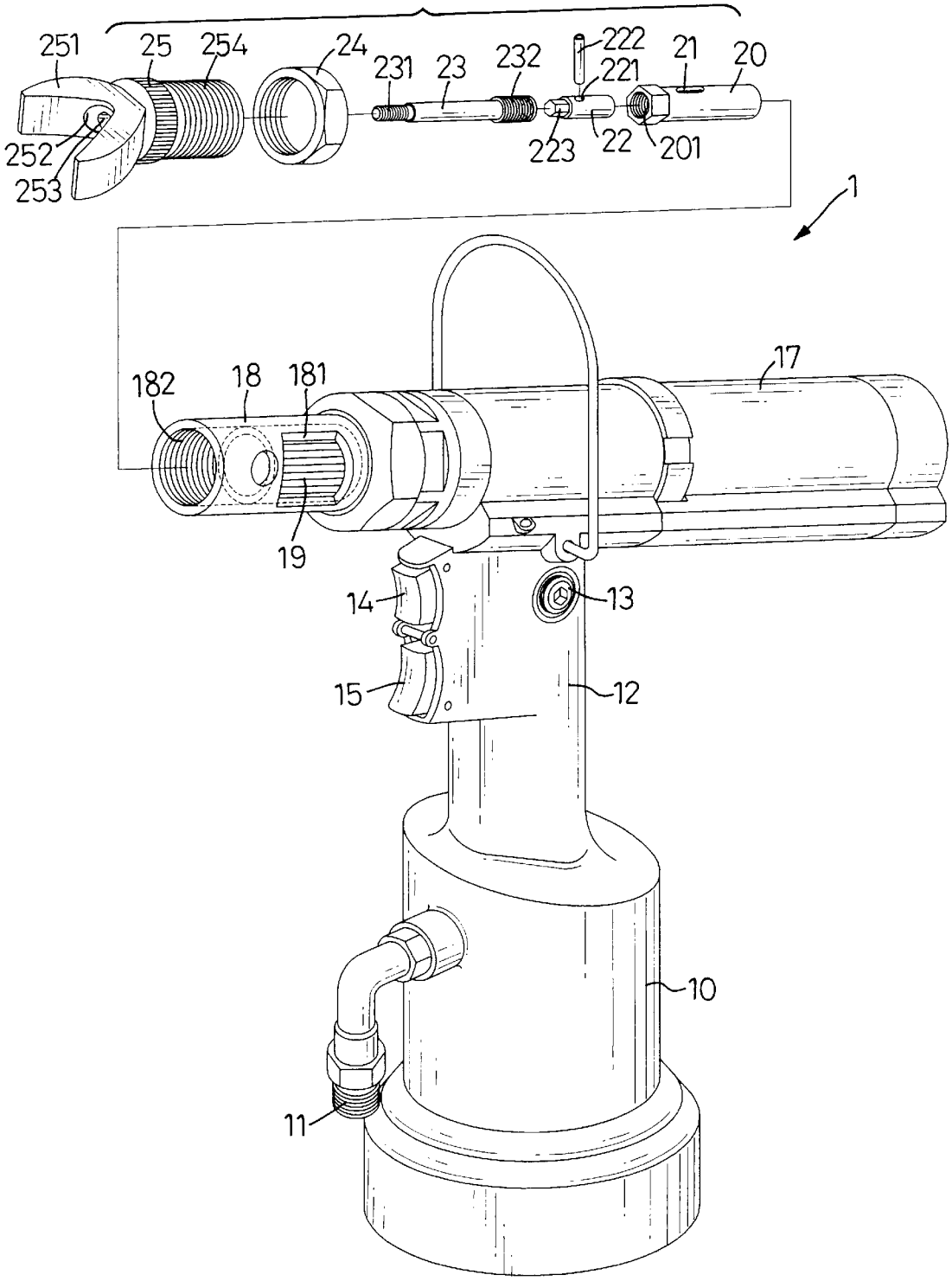
FIG. 2 is an exploded perspective view of the rivet tool head in FIG. 1.
Figure 3:
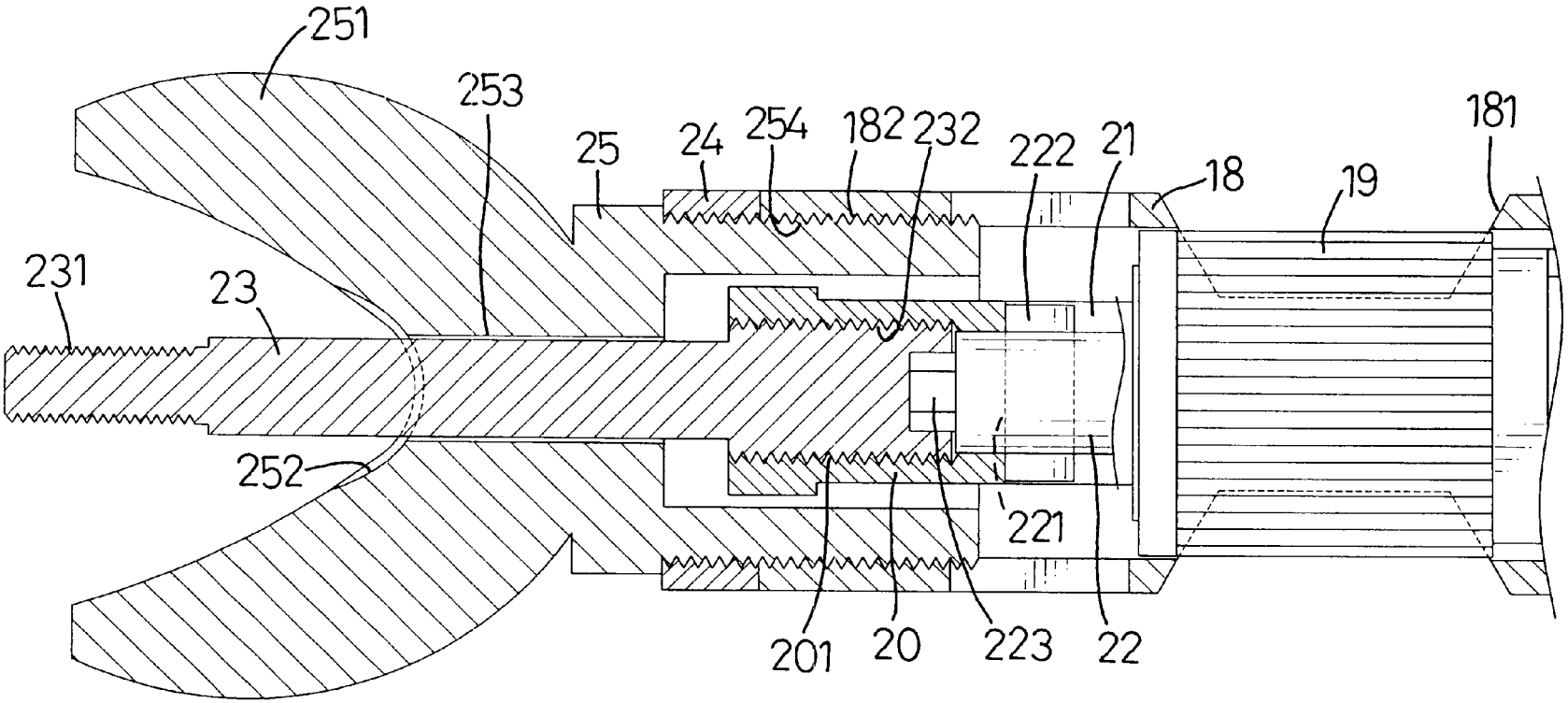
FIG. 3 is a cross sectional view of the rivet tool head taken from line 3—3 in FIG. 1.

With reference to FIGS. 2 and 3, the sleeve (18) has an inner threading (182). The rivet tool head includes a tube (20), a transmission rod (22), a bolt (23), a nut (24) and a head (25).

The tube (20) is adapted to be received in the adjusting knob (19) so that the tube (20) is driven by the rotation of the adjusting knob (19) to move linearly. The tube (20) has a front inner threading (201) and a slit (21) defined in a side face of the tube (20).

The transmission rod (22) is received in the tube (20) and has a hole (221) defined in a side face of the transmission rod (22) to correspond to the slit (21) of the tube (20), a pin (222) corresponding to the slit (21) and the hole (221), and a hexagonal head (223) formed on a front portion of the transmission rod (22).

The bolt (23) has a front threading (231) and a rear threading (232) corresponding to the front inner threading (201). The bolt (23) has an opening defined in a rear end of the bolt (23) to correspond to the hexagonal head (223) of the transmission rod (22). The rear opening of the bolt (23) is so configured that after the hexagonal head (23) is received in the rear opening of the bolt (23), there is no relative movement between the bolt (23) and the transmission rod (22).

The head (25) is Y-shaped and has two arms (251) extending outward from a body of the head (25), a recessed area (252) defined at a joint of the two arms (251), a through hole (253) defined in the recessed area (252) to correspond to the bolt (23) and a threaded extension (254) extending oppositely to the two arms (251) to correspond to the inner threading (182) of the sleeve (18).

When the aforementioned rivet tool head is in assembly, the transmission rod (22) is received in the tube (20) with the hole (221) aligned with the slit (21). The pin (222) is then inserted into the aligned hole (221) and slit (21) so that the movement of the transmission rod (22) inside the tube (20) is limited. Thereafter, engaging the hexagonal head (223) of the transmission rod (22) with the rear opening of the bolt (23) is able to ensure that there is no relative movement between the bolt (23) and the transmission rod (22). The front threading (231) extends out of the head (25) from the through hole (253). The nut (24) is threadingly mounted around the threaded extension (254) and then the threaded extension (254) is screwingly connected to the inner threading (182) of the sleeve (18) to complete the assembly of the rivet tool head.

Figure 4:
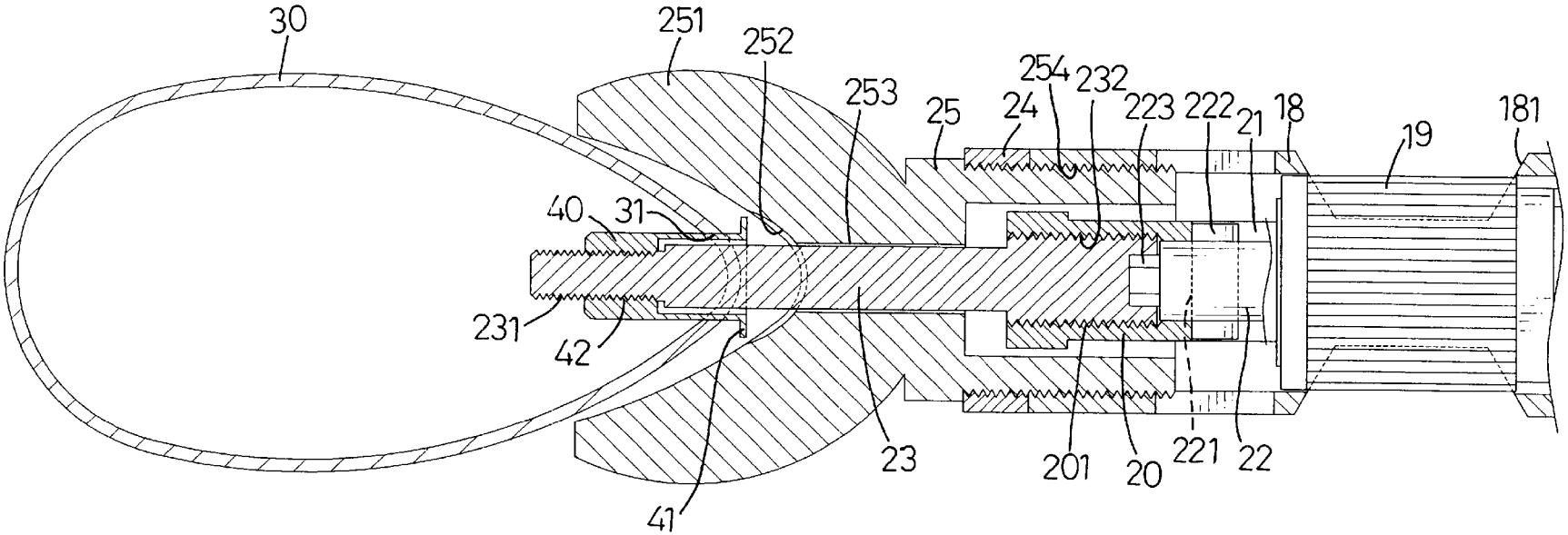
FIG. 4 is a schematic view showing that a rivet is mounted on the bolt and inserted into an oval tube.
Figure 5:
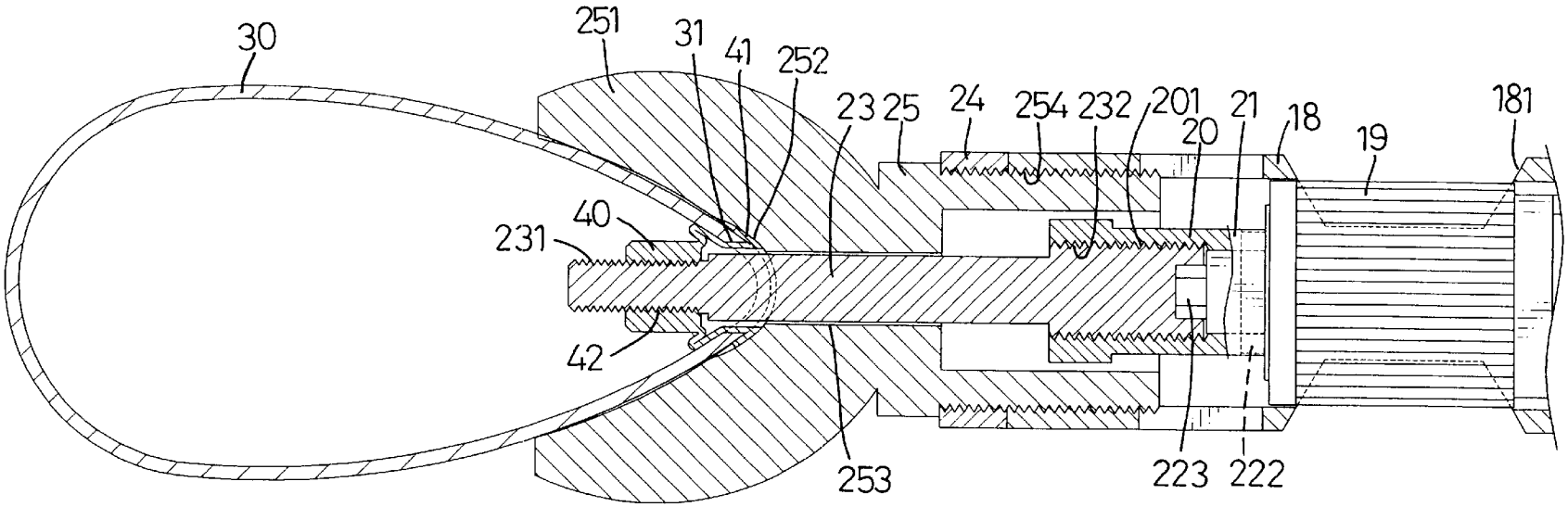
FIG. 5 is a schematic view showing the deformation of the rivet by using the Y-shaped rivet tool head of the present invention.
Figure 6:
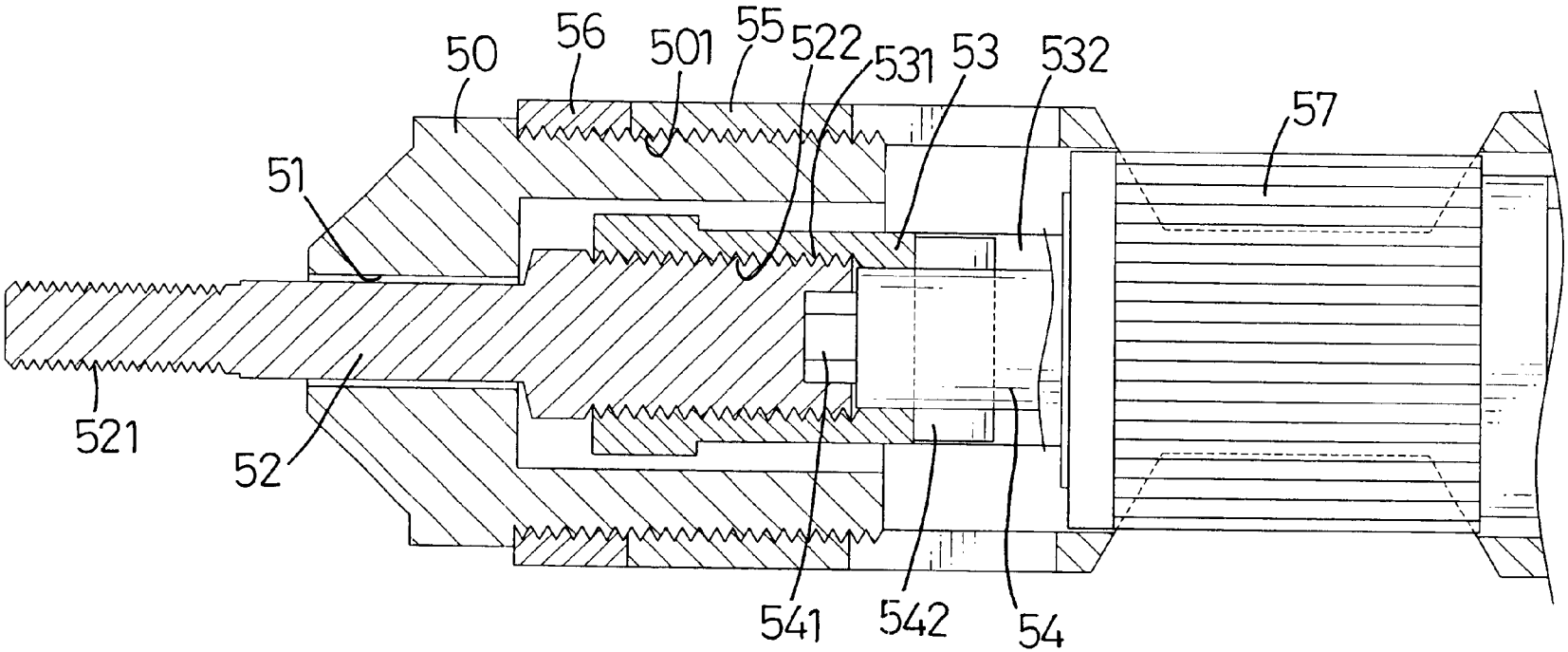
FIG. 6 PRIOR ART
FIG. 6 is a cross sectional view showing a conventional rivet tool head.

With reference to FIGS. 4 and 5, when the rivet tool head of the present invention is in use, a rivet (40) with a bore (42) is screwingly mounted around the front threading (231) and inserted into an aperture (31) in an oval tube (30). Then pressing the first trigger (14) is able to drive the tube (20) as well as the bolt (23) to move linearly (rearward) such that a peripheral edge (41) of the rivet (40) abuts the recessed area (252). When the force driving the tube (20) and the bolt (23) to move rearward is large enough to overcome the rigidness of the rivet (40), the peripheral edge (41) starts to deform. Because the bolt (23) has a diameter larger than that of the front threading (231), deformation in a mediate portion of the rivet (40) does not cave-in. Instead, thickness in the peripheral edge (41) stars to build up due to the deformation of the rivet (40). After the deformation of the rivet (40) finishes, pressing the second trigger (15) is able to rotate the tube (20), which also drives the transmission rod (22) as well as the bolt (23) to rotate. Consequently, the front threading (231) of the bolt (23) leaves the rivet (40) and thus the rivet tool head is ready for next process.

It is noted that during the deformation of the rivet (40), the peripheral edge (41) of the rivet (40) is able to smoothly engage with the recessed area (252) such that after the rivet tool is removed from the oval tube (30), the surface of the oval tube (30) is smooth and thus engagement of the rivet (40) to the oval tube (30) is secured.

It is to be understood, however, that even though numerous characteristics and advantages of the present invention have been set forth in the foregoing description, together with details of the structure and function of the invention, .the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A head assembly for a power rivet tool operable to install a rivet upon a tubular member having an aperture, the head assembly comprising:

a displaceable driving tube having a tubular body defining an axially extended bore, the tubular body including an internally threaded front portion and having formed thereon a slit communicating with the bore;

a transmission rod movably received in the tube, the transmission rod having formed in a side face thereof a hole communicating with the slit of the driving tube, the transmission rod having a front hexagonal head portion formed thereon;

a pin retentively engaging the hole of the transmission rod and the slit of the driving tube;

a bolt fixedly coupled to the transmission rod, the bolt having a front threaded section, a rear threaded section, and an intermediate section extending axially therebetween, the rear threaded section engaging the front portion of the displaceable driving tube;

a Y-shaped head disposed about at least a portion of the bolt, the Y-shaped head including a body portion and a pair of arm portions extending outward from the body portion, the arm portions defining therebetween a recessed area, the body portion having a through hole extending from the recessed area for coaxially receiving the bolt in displaceable manner therethrough, the front threaded section of the bolt projecting beyond the recessed area for engaging the rivet to be installed;

whereby the rivet is deformed against the recessed area responsive to linear displacement of the driving tube, the transmission rod, and the bolt relative to the Y-shaped head, a peripheral edge of the rivet being configured thereby to conform to an outer contour of the tubular member oval tube.

2. The head assembly for a power rivet tool as recited in claim 1 wherein the body of the Y-shaped head includes a threaded extension extending axially away from the arm portions for releasable coupling to the power rivet tool.

3. The head assembly for a power rivet tool as recited in claim 1 wherein the front threaded section of the bolt is less in diameter than the intermediate section of the bolt for radially supporting the rivet during the deformation thereof.

4. The head assembly for a power rivet tool as recited in claim 2 wherein the front threaded section of the bolt is less in diameter than the intermediate section of the bolt for radially supporting the rivet during the deformation thereof.

* * * * *